US011766602B2

(12) United States Patent
Miller

(10) Patent No.: US 11,766,602 B2
(45) Date of Patent: Sep. 26, 2023

(54) BOARD GAME FOR PROJECT MANAGEMENT METHODOLOGY DECISION-MAKING

(71) Applicant: Gloria J Miller, Wiesloch (DE)

(72) Inventor: Gloria J Miller, Wiesloch (DE)

( * ) Notice: Subject to any disclaimer, the term of this patent is extended or adjusted under 35 U.S.C. 154(b) by 134 days.

(21) Appl. No.: 17/328,931

(22) Filed: May 24, 2021

(65) Prior Publication Data

US 2022/0370888 A1 Nov. 24, 2022

(51) Int. Cl.
*A63F 3/00* (2006.01)

(52) U.S. Cl.
CPC ..... *A63F 3/00063* (2013.01); *A63F 3/00006* (2013.01); *A63F 2003/00009* (2013.01); *A63F 2003/00066* (2013.01); *A63F 2003/00747* (2013.01); *A63F 2003/00835* (2013.01); *A63F 2250/13* (2013.01)

(58) Field of Classification Search
CPC ..... A63F 3/00063; A63F 3/00006; A63F 2003/00009; A63F 2003/00066; A63F 2003/00747; A63F 2003/00835; A63F 2250/13
See application file for complete search history.

(56) References Cited

U.S. PATENT DOCUMENTS

| | | | | | |
|---|---|---|---|---|---|
| 3,850,433 | A * | 11/1974 | Purlia | A63F 3/00138 | 273/142 E |
| 4,991,853 | A | 2/1991 | Lott | | |
| 5,009,429 | A | 4/1991 | Auxier | | |
| 5,054,775 | A | 10/1991 | Banks et al. | | |
| 5,104,127 | A | 4/1992 | Whitney | | |
| 5,435,565 | A * | 7/1995 | Benaderet | A63F 3/0478 | 273/243 |
| 6,237,915 | B1 | 5/2001 | Ledet et al. | | |
| 6,817,613 | B2 * | 11/2004 | Hasek | A63F 3/00063 | 273/278 |
| 10,339,550 | B2 | 7/2019 | Rao | | |
| 10,713,897 | B2 | 7/2020 | Severance | | |
| 2015/0251083 | A1 * | 9/2015 | Wright | A63F 3/0457 | 273/242 |
| 2016/0328989 | A1 * | 11/2016 | Jicha | A63F 3/04 | |

* cited by examiner

*Primary Examiner* — Michael D Dennis

(57) ABSTRACT

The present invention relates to a board game apparatus for project management methodology decision-making. The players must decide on the project methodology, project scope, team composition, and issues and opportunities within the game's time and budget constraints. The players achieve the highest possible value while accounting for real-world issues and opportunities during the project life-cycle.

1 Claim, 20 Drawing Sheets

Team Member

Experience: 3+ yrs
Gender: Male
Company: External
Location: Asia

Skills
Consultant
Architect

| | Agile | Traditional |
|---|---|---|
| **Rate:** | 45 | 90 |
| **Work Points:** | 3 | 7 |

Team Member

Experience: 3+ yrs
Gender: Male
Company: Internal
Location: Europe

Skills
Systems Engineer

| | Agile | Traditional |
|---|---|---|
| **Rate:** | 100 | 200 |
| **Work Points:** | 6 | 13 |

Team Member

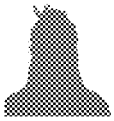

Experience: 3+ yrs
Gender: Male
Company: External
Location: America

Skills
Agile Coach

| | Agile | Traditional |
|---|---|---|
| **Rate:** | 325 | 650 |
| **Work Points:** | 0 | 0 |

Team Member

Experience: 7+ yrs
Gender: Female
Company: External
Location: America

Skills
Consultant

| | Agile | Traditional |
|---|---|---|
| **Rate:** | 325 | 650 |
| **Work Points:** | 6 | 13 |

Team Member

Experience: 1+ year
Gender: Female
Company: External
Location: Europe

Skills
Architect
Systems Engineer

| | Agile | Traditional |
|---|---|---|
| **Rate:** | 50 | 100 |
| **Work Points:** | 2 | 5 |

Team Member

Experience: 15+ yrs
Gender: Female
Company: External
Location: Europe

Skills
Marketing

| | Agile | Traditional |
|---|---|---|
| **Rate:** | 550 | 1100 |
| **Work Points:** | 14 | 30 |

Team Member

Experience: 15+ yrs
Gender: Female
Company: Internal
Location: Europe

Skills
Project Manager

| | Agile | Traditional |
|---|---|---|
| **Rate:** | 525 | 1050 |
| **Work Points:** | 0 | 0 |

Team Member

Experience: 7+ yrs
Gender: Male
Company: External
Location: Europe

Skills
Product Owner

| | Agile | Traditional |
|---|---|---|
| **Rate:** | 350 | 700 |
| **Work Points:** | 0 | 0 |

Team Member

Experience: 3+ yrs
Gender: Female
Company: Internal
Location: Europe

Skills
Technical Writer

| | Agile | Traditional |
|---|---|---|
| **Rate:** | 135 | 270 |
| **Work Points:** | 9 | 19 |

FIG. 6A

| | | |
|---|---|---|
| Issue & Opportunity<br>Stable team with high productivity; exceed expected plans<br>**Achieve an extra product feature in the current sprint or phase without requiring an additional team member**<br>Opportunity Process | Issue & Opportunity<br>Frequent turnover within the development team; missed delivery date<br>**No value credits earned for the current sprint for an agile project; pay extra team expense for traditional project**<br>Issue Process | Issue & Opportunity<br>Your architect changes his private schedule and contributes additional effort<br>**Double work points for the architect in this phase or sprint**<br>Opportunity Process |
| Issue & Opportunity<br>Your architect is sick<br>**No work points for the architect in this phase or sprint**<br>Issue Process | Issue & Opportunity<br>Properly defined roles and responsibilities; exceed expected plans<br>**Go forward two spaces**<br>Opportunity Process | Issue & Opportunity<br>Improper definition of roles and responsibilities<br>**Add an agile coach or additional project manager for the next sprint or phase**<br>Issue Process |
| Issue & Opportunity<br>Adequate composition of the project team; exceed expected plans<br>**Win 500 value credits**<br>Opportunity Process | Issue & Opportunity<br>Inadequate composition of the project team<br>**Add a new team member; pay immediately**<br>Issue Process | Issue & Opportunity<br>Strong knowledge management; able to reuse previous works<br>**Go forward two spaces**<br>Opportunity Process |

FIG. 7A

| | | |
|---|---|---|
| Issue & Opportunity<br>The location accuracy of the GPS has increased<br>**Win 200 value credits**<br>Opportunity Quality | Issue & Opportunity<br>The location accuracy of the GPS is insufficient<br>**Lose 200 value credits**<br>Issue Quality | Issue & Opportunity<br>The mobile data option is widely available<br>**Win 500 value credits**<br>Opportunity Quality |
| Issue & Opportunity<br>The mobile data service is poor, e.g., not ready on-time<br>**Lose 500 value credits**<br>Queue<br>Issue Quality | Issue & Opportunity<br>The smartphone is available to buy in more shops than planned<br>**Win 1000 value credits**<br>Opportunity Quality | Issue & Opportunity<br>The smartphone availability to purchase is delayed<br>**Lose 500 value credits**<br>Issue Quality |
| Issue & Opportunity<br>The operating system is one of the most comprehensive on the market<br>**Win 100 value credits**<br>Opportunity Quality | Issue & Opportunity<br>The operating system of the smartphone is missing key features<br>**Lose 500 value credits**<br>Issue Quality | Issue & Opportunity<br>Internal compliance checks passed faster than expected<br>**If an internal project team member is on the team, win 500 value credits**<br>Opportunity Quality |

FIG. 7B

| | | |
|---|---|---|
| Issue & Opportunity<br>Critical activities have been identified; the project plan is sufficient to win market recognition<br>**Win 500 value credits**<br>Opportunity Strategy | Issue & Opportunity<br>Critical activities are not identified<br>**Add a new team member; pay immediately**<br>Issue Strategy | Issue & Opportunity<br>New software release planned; increased team efficiency<br>**Receive 1000 for a team event**<br>Opportunity Strategy |
| Issue & Opportunity<br>New software release; need to buy a new release and upgrade all systems<br>**Pay 1000 for upgrades**<br>Issue Strategy | Issue & Opportunity<br>Sufficient estimation of required resources<br>**Go forward two spaces**<br>Opportunity Strategy | Issue & Opportunity<br>Inadequate estimation of required resources<br>**Increase team size so the currently available team can deliver all product features**<br>Issue Strategy |
| Issue & Opportunity<br>Adequate project planning<br>**Go forward two spaces**<br>Opportunity Strategy | Issue & Opportunity<br>Poor project planning<br>**Add an additional project manager for the next sprint or phase**<br>Issue Strategy | Issue & Opportunity<br>It's a public holiday at your location that was considered in the plan<br>**Go forward two spaces**<br>Opportunity Strategy |

FIG. 7C

Issue & Opportunity

Reasonable project size, freeing more budget

Receive additional budget based on current team costs

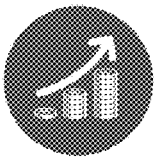

Opportunity Structure

Issue & Opportunity

Excessive project size

Return highest value product feature to the stack until the next sprint-start or phase-end

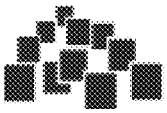

Issue Structure

Issue & Opportunity

Top management is committed to the project

Go forward two spaces

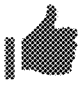

Opportunity Structure

Issue & Opportunity

Lack of top management commitment to the project

Go back two spaces

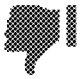

Issue Structure

Issue & Opportunity

Realistic projects outcomes

Receive additional budget based on current team costs

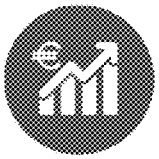

Opportunity Structure

Issue & Opportunity

Change in ownership or senior management during the process of development

Go back two spaces

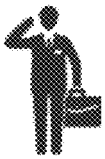

Issue Structure

Issue & Opportunity

Stable ownership or senior management during the process of development; proceed at a faster pace than expected

Go forward two spaces

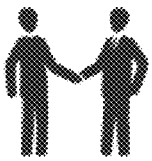

Opportunity Structure

Issue & Opportunity

Top managers make important decisions without consulting the others

Return highest value product feature to the stack until the next sprint-start or phase-end

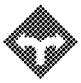

Issue Structure

Issue & Opportunity

Top managers consult others before making important decisions

Receive additional budget based on current team costs

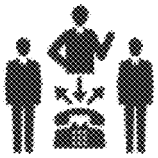

Opportunity Structure

FIG. 7D

| | | |
|---|---|---|
| Issue & Opportunity<br>There is good cooperation between users' departments; exceed expected plans<br>**Go forward two spaces**<br>Opportunity Team & Roles | Issue & Opportunity<br>Conflicts between users' departments<br>**Go back two spaces**<br>Issue Team & Roles | Issue & Opportunity<br>There is good cooperation with suppliers and vendors<br>**Go forward two spaces**<br>Opportunity Team & Roles |
| Issue & Opportunity<br>Conflicts with suppliers and vendors<br>**Go back two spaces**<br>Issue Team & Roles | Issue & Opportunity<br>Customer available for important meetings<br>**No work points for this phase or sprint**<br>Collaboration<br>Opportunity Team & Roles | Issue & Opportunity<br>Customer not available for important meetings<br>**No work points for this phase or sprint**<br>Issue Team & Roles |
| Issue & Opportunity<br>Good user participation; over achieve plans<br>**Achieve an extra product feature in the current sprint or phase without requiring an additional team member**<br>Opportunity Team & Roles | Issue & Opportunity<br>Lack of user participation<br>**No value credits earned for the current sprint for an agile project; pay extra team expense for traditional project**<br>Issue Team & Roles | Issue & Opportunity<br>The public is excited about the new mobile service<br>**If a marketeer is in the team, win 500 value credits**<br>NEW<br>Opportunity Team & Roles |

FIG. 7E

| | | |
|---|---|---|
| Issue & Opportunity<br>A reasonable level of technical complexity<br>**A junior architect has sufficient experience to manage the project**<br>Opportunity Technology | Issue & Opportunity<br>High level of technical complexity<br>**Add the most experienced architect if not already in the team; pay immediately**<br>Issue Technology | Issue & Opportunity<br>Mature technology<br>**A junior architect has sufficient experience to manage the project**<br>Opportunity Technology |
| Issue & Opportunity<br>Immature technology<br>**Add the most experienced architect if not already in the team; pay immediately**<br>Issue Technology | Issue & Opportunity<br>Necessary system and process documentation exists and is complete<br>**A technical writer is not needed in the project team**<br>Opportunity Technology | Issue & Opportunity<br>Inadequate system and process documentation; incomplete or non-existent<br>**Add a technical writer if not already in the team; pay immediately**<br>Issue Technology |
| Issue & Opportunity<br>Effective development methodology<br>**A junior architect has sufficient experience to manage the project**<br>Opportunity Technology | Issue & Opportunity<br>Lack of effective development methodology<br>**Add the most experienced project manager or scrum master if not already in the team**<br>Issue Technology | Issue & Opportunity<br>Systems and processes are adequately integrated<br>**A junior architect has sufficient experience to manage the project**<br>Opportunity Technology |

FIG. 7F

Product Cards

Item

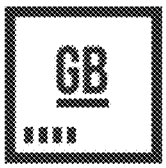

Built-in Memory

BUILT-IN MEMORY

Work Point: 8 | Value Credits: 800

Optionality: Optional

Product Cards

Item

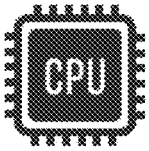

Processors

PROCESSOR

Work Point: 13 | Value Credits: 0

Optionality: Mandatory

Product Cards

Item

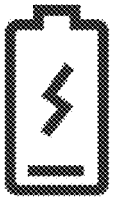

Power Battery

BATTERY POWER

Work Point: 8 | Value Credits: 0

Optionality: Mandatory

Product Cards

Item

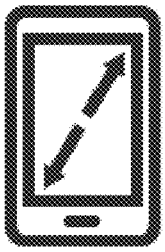

Screen

SCREEN

Work Point: 13 | Value Credits: 0

Optionality: Mandatory

Product Cards

Item

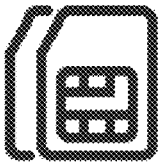

Sim Card

SIM CARD

Work Point: 3 | Value Credits: 300

Optionality: Optional

Product Cards

Item

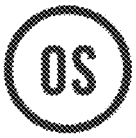

Operating System

OPERATING SYSTEM

Work Point: 13 | Value Credits: 0

Optionality: Mandatory

Product Cards

Item

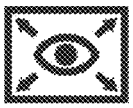

Resolution Basic

RESOLUTION

Work Point: 13 | Value Credits: 1300

Optionality: Optional

Product Cards

Item

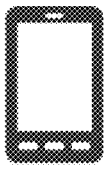

Basic Case

Phones

Work Point: 34 | Value Credits: 0

Optionality: Mandatory

Product Cards

Item

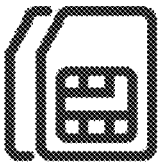

Memory card Small

SIM CARD

Work Point: 5 | Value Credits: 2000

Optionality: Optional

FIG. 8A

BOARD GAME FOR PROJECT MANAGEMENT METHODOLOGY DECISION-MAKING

FIELD OF THE INVENTION

The present invention relates to a board game apparatus for project management methodology decision-making.

DESCRIPTION OF RELATED ART

A portion of the disclosure of this patent document contains material that is subject to copyright protection. The copyright owner has no objection to the facsimile reproduction of the patent disclosure, as it appears in the Patent and Trademark Office patent file or records. Otherwise, all copyright rights are reserved.

Multitudes of board games are known in the prior art. For example, U.S. Pat. No. 5,435,565 discloses a board game for simulating stressful and cheerful situations. U.S. Pat. No. 4,991,853 discloses a financial board game apparatus simulating corporate takeovers. U.S. Pat. No. 10,713,897 reveals an electronic trading-themed video game. U.S. Pat. No. 5,104,127 discloses a board game that imitates the variety and spice of life. U.S. Pat. No. 5,009,429 discloses a board game and play method that emulates business property manipulation and retail sales. U.S. Pat. No. 5,054,775 discloses a card game relating to personal relationships.

Furthermore, board games have been used for skills development in the business, financial, and project management domains. Specifically, for teaching project management skills, U.S. Pat. No. 6,237,915 and U.S. Pat. No. 6,817,613 disclose a board game and U.S. Pat. No. 10,339,550 uses a computerized game. These games focus on teaching a traditional project methodology, which breaks work into tasks.

Each of the devices focuses on its respective theme and a mode of play. The patents mentioned do not describe a board game for comparing the impacts between different project management methodologies on achieving the highest possible value outcome for new product development projects while addressing issues and opportunities within time and budget constraints.

In this respect, the board game described in this disclosure departs from the concepts and designs of the prior art by having players make project management methodology decision making. The players must decide on the project methodology, project scope, team composition, and issues and opportunities within the game's time and budget constraints. The players achieve the highest possible value while accounting for real-world issues and opportunities during the project lifecycle. It is desirable to experience the impacts of project management decisions while having fun.

SUMMARY

At its core, the game is related to project management decision-making. Specifically, it relates to making methodology and other decisions for a new product development project, intending to deliver the end-product and gain as many value credits as possible within the project time and budget constraints. The game introduces risks, issues, and opportunities during play related to how the product features are delivered and the team members' interaction. The game demonstrates the comparative impacts between multiple methodologies, such as traditional and agile methodologies, on reaching the project goal, The invention is comprised of, in combination, a board with several tiles that represent a time dimension, numbered dice, colored dice, cards representing issues and opportunities that can randomly occur during a play, varying nomination chips that represent money, variable value cards that represent benefits, avatars that represent the players that traverse the boards, multiple sets of cards that represent people that form a team and the product to be constructed during the play, and the rules.

Each player is provided with a stack of team member cards that describe people's profiles that the player may select as the project team members, Each team member has personal attributes, work points for the amount of work the team members can contribute in a given timeframe, and a price for a given timeframe, Each player is provided with a stack of product cards. Each product card represents a feature of the product that will be constructed during play. Each product feature has an attribute that defines a mandatory or optional quality, a value credit it is worth if implemented, and the work points representing the amount of work to implement the feature. Each player is given a fixed budget of monetary chips that represent the economic value that may expend during the play.

The players make a set of decisions at the start of play; they roll the numbered dice to traverse the board as through time, and they react to events that occur while traversing the board, The player with the most value credits at the end of the game is the winner.

BRIEF DESCRIPTION OF THE DRAWINGS

FIG. 6A is an example of nine team member cards.

FIG. 7A to 7F are examples of issue and opportunity for different frameworks.

FIG. 8A is an example of nine product cards.

DETAILED DESCRIPTION

Projects are temporary undertakings to achieve a specific goal constrained by time, budget, and available resources. There are multiple methodologies and approaches for a project to achieve its goal. Project managers have to make several decisions at the start of the project, such as the methodology, scope, and team necessary to reach the goal, There are tradeoffs in selecting one methodology over another or staffing a team with one set of people versus another group, It is not easy for project managers to conceptualize or judge the impacts of their decisions on project outcomes. Agile methodologies, such as Scrum, Disciplined Agile, waterfall software development or other methodology, have short delivery cycles but high flexibility in changing the scope and the team members; there are planning sessions throughout the project. Furthermore, the agile methodologies tend to focus on incrementally delivering product features. Traditional methodologies require detailed planning at the start of the project and discourage changes in scope. The traditional methodologies tend to focus on the tasks required to deliver a complete product by the end of the project. Thus, the project manager can prepare the team and anticipate the outcome.

Agile methodologies have introduced radial changes over traditional methods in the ways that projects are managed. The scope change process is integrated into the planning process, The planning process is distributed throughout the project. The teams should self-organize their work and the scope in an iterative fashion. Teams are composed of roles that differ from those in traditional methodology. Agile methods are not appropriate for all types of projects. The project management decisions impact how and when the value is delivered to the client or the market. Managers and project managers struggle to understand the impacts of selecting the way to run the project and their decisions on the project outcome.

A game that demonstrates the comparative impacts of project decision-making, especially between traditional and agile methodologies on reaching the project goal, is desirable. The game forces the players to plan a project and experience their decisions on achieving the project goals. R interjects real-world risks, issues, and opportunities in any project type. Still, it has different consequences based on the project methodology.

Design of the Game

Figure 1:
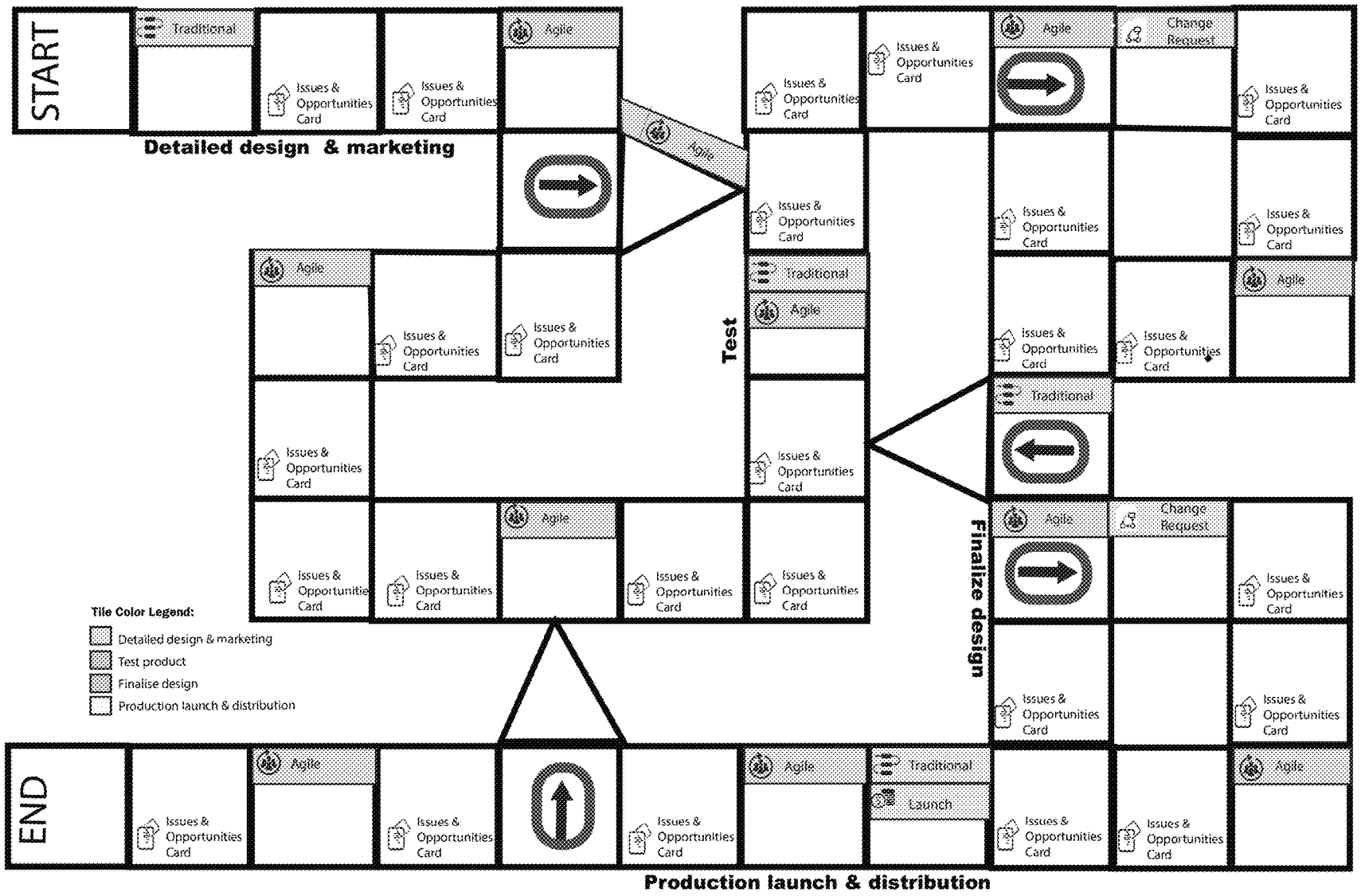
FIG. 1 is an example view of the game board of the present invention.

FIG. 1 through FIG. 9 illustrates the game's components embodying the principles, rules, and concepts of the present invention. The present invention includes nine significant components: the game board 300, avatars 105, numbered dice 110, colored dice 111, monetary chips 115, value credit cards 120, issues and opportunity cards 125, team member cards 130, product cards 135, and the instruction guide 450. The components are interrelated to provide the intended function. The game components may be constructed for a tabletop game, an online computer game, or a mobile application. FIG. 10 illustrates the computing environment for a computer online or software application version of the game. FIG. 1 illustrates the game board 300 with a start-tile 305, the time-tiles 310, an end-file 330, and the risk-tiles 320. The game board 300 is a two-dimensional planar structure that is the playing surface; the dimensions may vary for example a 508 mm wide by 400 mm high cardboard option. The game board 300 includes the start-tile 305 representing the initiation of a journey through time. The start-tile 305 is located near the upper-left edge of the game board 300. The time journey is characterized by a multitude of time-tiles 310 representing a unit of time, e.g., day, week, month, or any alternative period. Each unit of time is defined by a- time-tile 310. For the main route, each of the time-tile 310 is in a sequence on the game board 300 so that the time-tile 310 fit on the board until reaching the end-tile 330. The end-tile 330 is positioned near the lower-left edge of the game board 300. A time-tile 310 maybe connect to a risk-tile 320 representing perils that redirect the player from one time-tile 310 to another time-tile 310. The risk-file 320 may turn the player to a time-tile 310 that defines a future period for a favorable opportunity. The risk-tile 320 may redirect the player to a time-tile 310 representing a past period for a negative consequence. A time-tile 310 may direct the player to an alternative route 325. An alternative route 325 is a detour 321 that extends the player's journey through the game board 300 by adding additional interconnected time-tiles 310 that start at a time-tile 310 on the main route and end at another time-tile 310 on the main route.

Figure 1A:
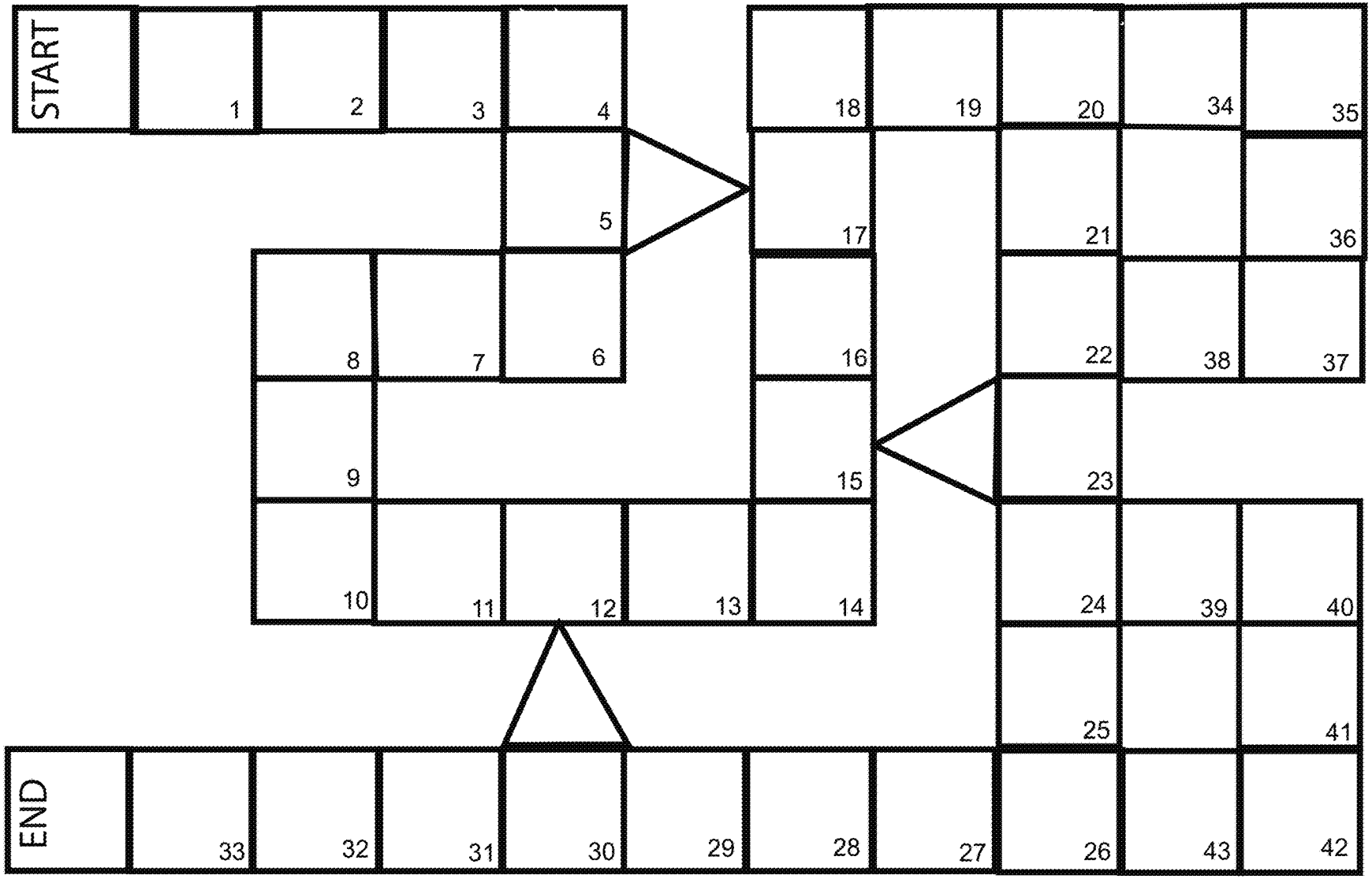
FIG. 1A is the game board with the tiles numbered.
Figure 1B:
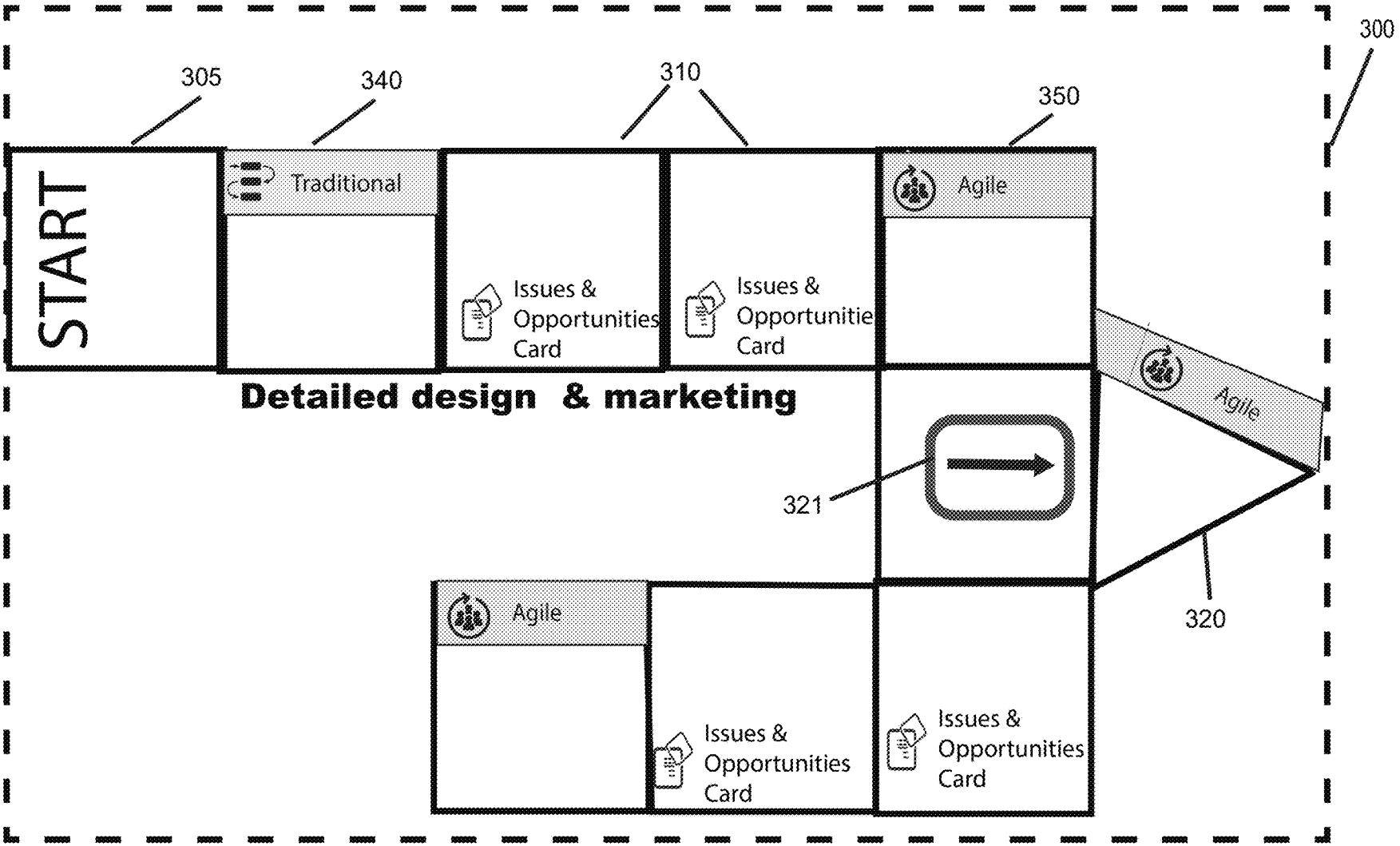
FIG. 1B, 1C, and 1D are cutout views of sections of the game board.
Figure 1C:
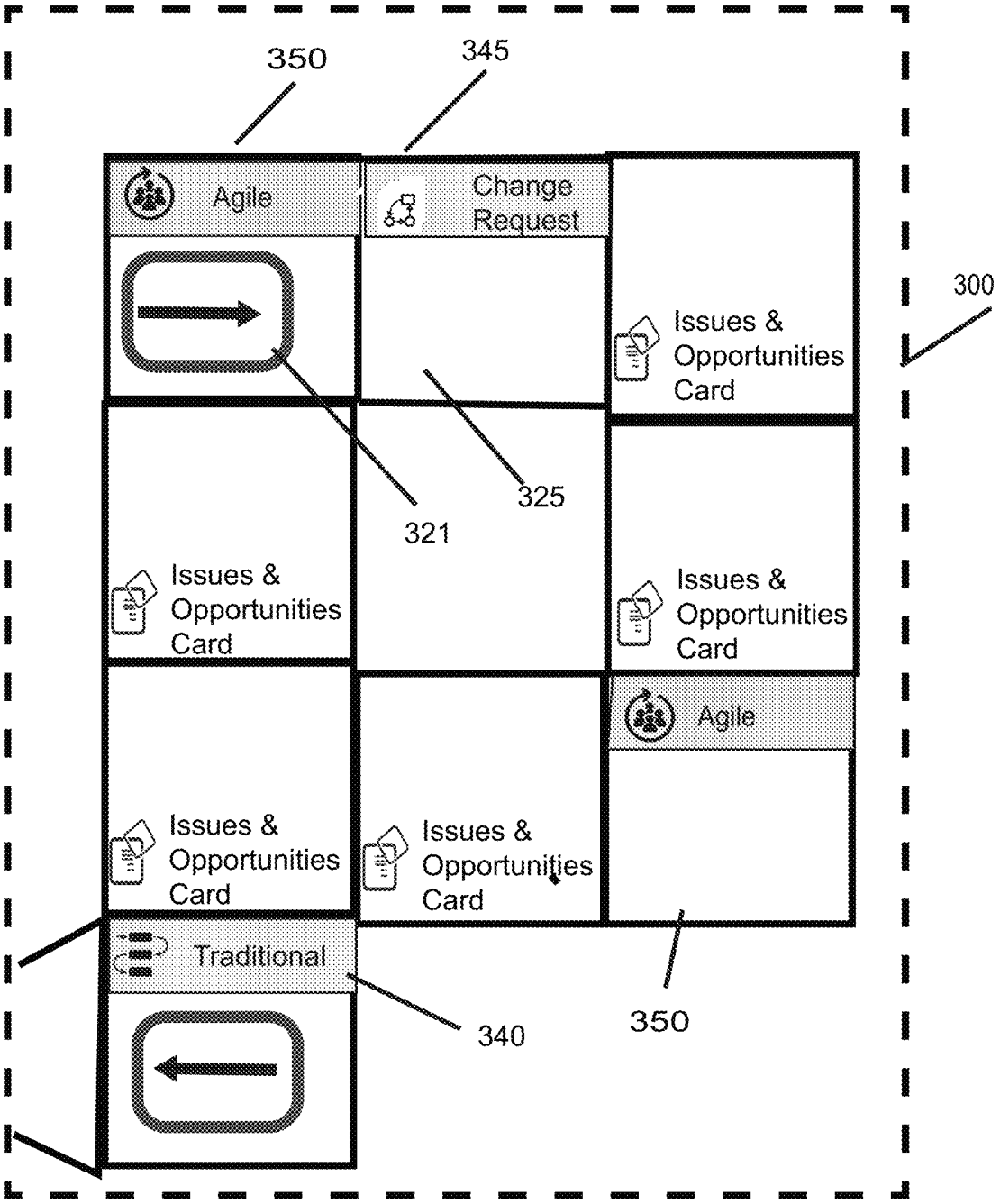
Figure 1D:
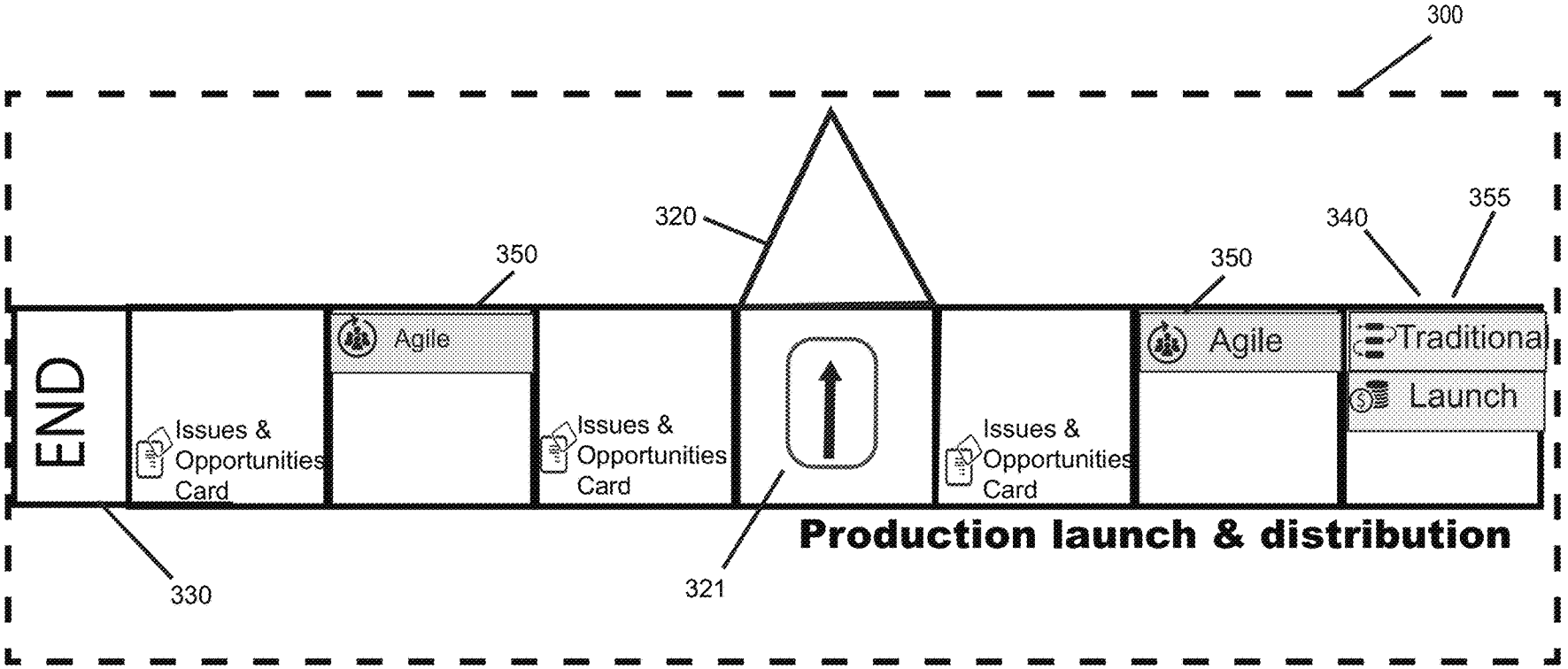

The game board 300 is designed for two project methodologies; for example, the first methodology is a traditional methodology with project phases and the second methodology is an agile methodology with fixed time iterations called sprints in the Scrum methodology. For traditional methodology, the time tiles 310 for each phase-start is marked with 'Traditional,' tiles are marked to denote changes in scope, e.g., 'Change Request.' A the is marked with 'Launch' to identify when value credits may be recognized. These are phase-start tiles 340, change-request tiles 345, and product-launch tiles 355, respectively. In the preferred embodiment, there are four phase-start tiles 340 and two change-request tiles 345. Each of the time-tiles 310 on the game board 300 is part of a phase of a project. The time-tiles 310 are color-coded to identify the phase to which they belong. The four phases for the illustrated traditional methodology represent the detailed and design marketing phase, the test phase, the finalize design phase, and the production launch and distribution phase. The four phases for a waterfall software development methodology may include requirements and design, development, test, and deployment and handover, for example. The game board 300 includes a legend for the phase color coding and the name of the game. For agile methodology, the time-tiles 310 on the game board 300 are marked with 'Agile' represents an iteration-end. FIG. 1A, FIG. 1B, and FIG. 1C illustrates sections of the game board 300 with details shown for the time-tile 310 encodings. Inscriptions for other methodologies may be considered for differing board designs; however, the board should include two methodologies.

Several of the time-tiles 310 on the game board 300 are encoded with actions that the player must take if their avatar 105 lands on the time-tile 310 during play. The types of activities are taking an issue and opportunity cards 125 or taking a detour 321. For the time-tile 310 with issue and opportunities, the player must take an issue and opportunity card 125 and perform the action described on the card. The card is returned to the bottom of the stack. For the time-the 310 with a detour 321, the player must move as directed by the detour 321 to a risk-tile 320 or an alternative route 325.

In FIG. 1A preferred embodiment, the game board 300 shows numbers for each of the time-tiles 310; the game board 300 has 43 of the time-tiles 310; the one is connected to the start-tile 305, the board is with a direct path to time-tile 33 connected to the end-tile 330. The game board 300 playing area is a rectangular plane. There are three risk-tiles 320; the risk-tiles 320 are connected from time-tile 5 pointing to time-tile 17, from time-tile 23 pointing to time-tile 15, and from time-tile 30 pointing to time-tile 12.FIG. 1A shows the risk-tile 320 at time-tile 5. There are two alternative routes 325; one is from true-tile 20 to time-tile 34, ending at time-tile 38 that connects to time-tile 22, and from time-tile 24 to time-tile 39, ending a time-tile 43that connects to time-tile 26. The detour 321 at time-tile 20 is shown in FIG. 1B. The time-tiles 2, 3, 6, 7, 9, 10, 11, 13, 14, 15, 17, 18, 19, 21, 22, 25, 26. 29, 31, 33, 35, 36, 38, 40, 41, and 43 are marked with representations that the player should take an issues and opportunity cards 125. The time-tiles 5, 20, 23, 24, and 30 are marked with a detour 321. The phase-start tiles 340 are represented on time-tiles 1, 16, 23, 27. The change-request tiles are time-tiles 34 and 40. The time-tiles 4, 8. 12, 16, 20, 24, 28, 32, 37, 42, and the risk-tile 320 connected to time-file 5 are marked as iteration-end tiles 350. The product-launch the 355 is at time-tile 27, as shown in FIG. 1C. The time-tiles 310 for the detailed and design marketing phase are time-tiles 2 through 15. The test phase is 16 through 22 and 34 through 39, the finalize design phase is 23 through 26 and 40 through 43, and the production launch and distribution phase are 27 through 33.

Figure 2A:
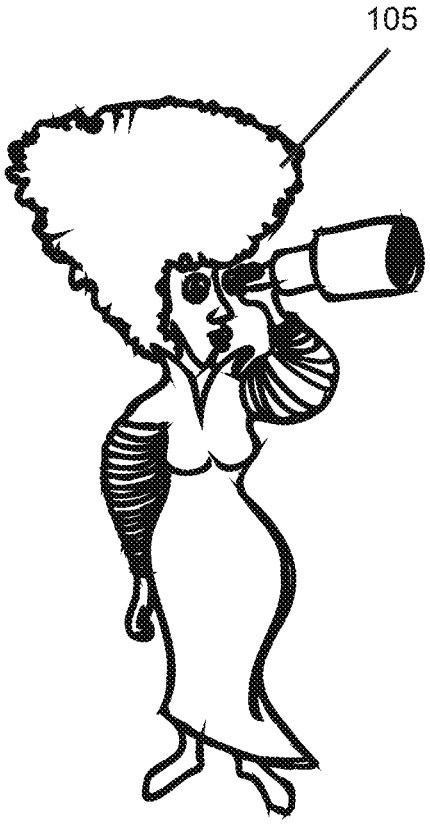
FIG. 2A and 2B represents avatars that are the game pieces used to traverse the board.
Figure 2B:
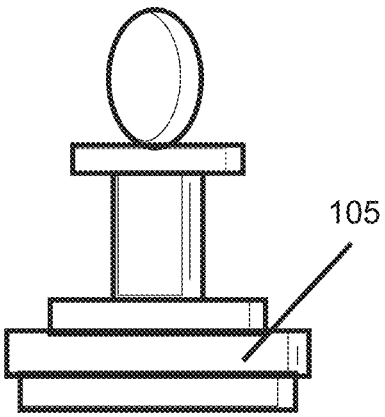

FIG. 2A and FIG. 23 illustrate avatars 105. The avatars 105 are the game pieces that are used to traverse the board and represent the players. The number of avatars represents the number of game players. The game players may be individuals or collectives such as the team, As shown in FIG. 2A, the avatars 105 may be stylized humanoid shape based on professional and personal attributes. Alternatively, as shown in FIG. 23, the avatars 105 may be the same shape, with color being the distinguishing characteristics with no additional professional or personal attributes. Red, yellow, green, and blue, pawn-like pieces are examples of avatars where color is the distinguishing factor. Example content of the avatars 105 with professional and personal attributes is given in as follows.

Avatars 105

Avatar Title: The achiever

Profile Summary: good at achieving results

Professional and personal attributes: perseverance, information seeking

Avatar Title: The super (wo)man

Profile Summary; good at everything

Figure 3:
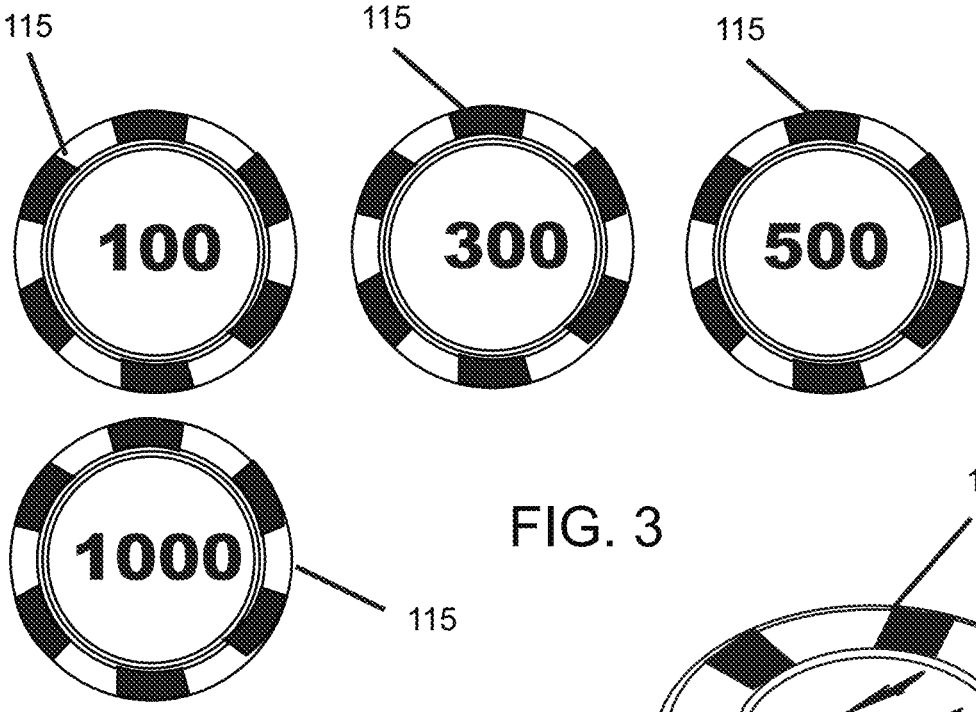
FIG. 3 is a plane view of the chips that represent the monetary value.
Figure 3A:
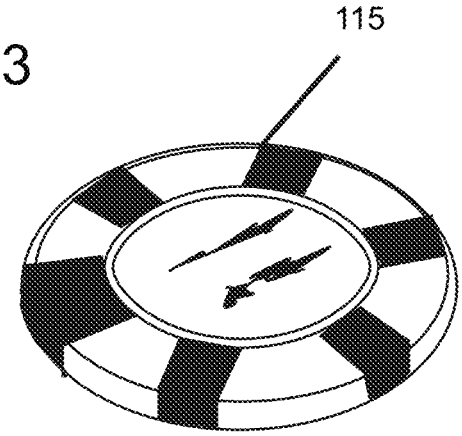
FIG. 3A is a perspective view of one of the chips that represent the monetary value.

Professional and personal attributes: Interpersonal understanding, teamwork and cooperations, analytical thinking Avatar Title: The egotist Profile Summary: good at self-promotion Professional and personal attributes: self-confidence, managerial courage Avatar Title: The politician Profile Summary: good at navigating complex situations Professional and personal attributes; politically savvy, patience Avatar Title: The negotiator Profile Summary: good a making deals Professional and personal attributes: impact and influence, negotiate Avatar Title: The influencer Profile Summary; good at getting management/senior people to act Professional and personal attributes: relationship building, dealing with authority Avatar Title: The coach Profile Summary: good a developing people Professional and personal attributes: developing others, directiveness Avatar Title: The leader Profile Summary; good a building connection between people working for them Professional and personal attributes: conflict management, confronting direct reports Avatar Title: The visionary Profile Summary: good at painting a vision but no details Professional and personal attributes: conceptual thinking, creativity Avatar Title: The networker Profile Summary: good a building networks of people Professional and personal attributes: flexibility, strategic agility FIG. 3 illustrates monetary chips 115 in the denominations of 100, 300, 500, and 1000. The denominations combined with the number of units determine the maximum allowable budget for the game, There is a plurality of monetary chips 115 for each denomination. Each player is initially given monetary chips that represent a project budget. Throughout the gameplay, monetary chips 115 are used to conduct financial transactions such as paying for team members or responding to an issue or opportunities based on player situations. FIG. 3A is a perspective view of a monetary chip 115.

Figure 4:
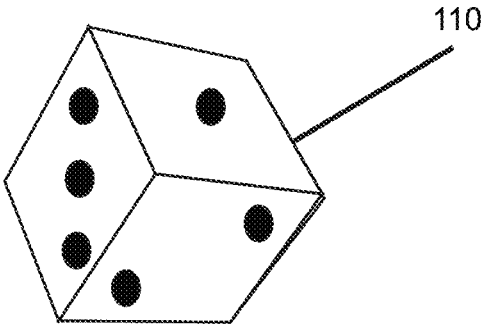
FIG. 4 is a perspective view of the numbered dice used in the board game.
Figure 5:
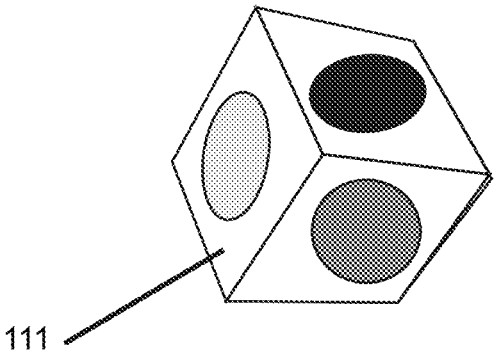
FIG. 5 is a perspective view of the colored dice used in the board game.

FIG. 4 demonstrates the numbered dice 110, a box shape with six faces and a number from one to six on each side. One numbered dice 110 is rolled per player per turn. During play, the player progresses the avatar 105 by rolling the numbered dice 110 and moving the number of time-tiles reflected by the face. FIG. 5 illustrates a colored dice 111, a box shape with six faces and a different color on each side, resulting in six colors; optionally, it is used for selecting the issue and opportunity card 125. The colored dice 111 is rolled when the player lands on a time-tile inscribed with issues and opportunity. The player selects the issue and opportunity card 125 that corresponds to the color on the face of the colored dice 111.

Figure 6:
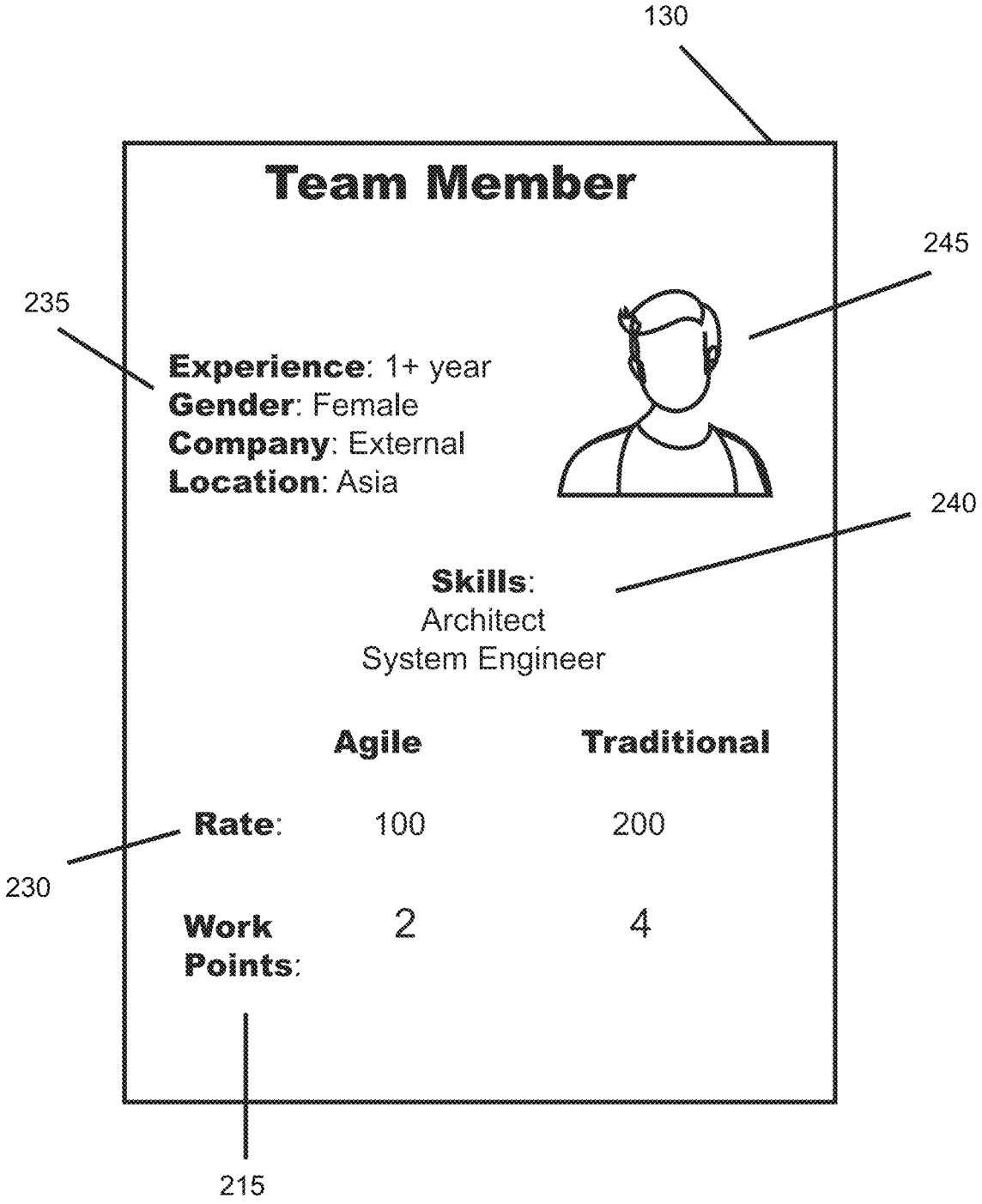
FIG. 6 is a plane view of the team member cards use to construct the team.

FIG. 6 illustrates the front face of the team member cards 130 for the preferred embodiment. The team member cards 130 represent individuals who can perform work on creating the target product. The front-face of each team member card 130 is denoted with attributes that describe the individual's profile 235, a profile picture 245, skills 240, monetary rate 230, work points 215. The individual's profile 235 attributes include individual characteristics relevant to deciding the individual's background or personal attributes. Examples of profile capabilities include years of experience, gender, company, geographic location, availability, personality characteristics. The team member cards 130 also identify the skills 240. Skills are an essential attribute in formulating the team composition. The company options are internal or external, representing if the individual is an internal employee of the company building the product or an external supplier, vendor, or from another third-party organization. The monetary rate 230 is the price of using the individual for each project phase or iteration for traditional or agile methodologies. The work points 215 represent the output productivity of the individual for a project phase or an iteration. There are identical stacks of team member cards 130 so that each player may have a stack of cards with the same content. In alternative play scenarios, the cards may be distributed in various constellations. The rear face identifies the card as a team member cards 130. FIG. 6A provides an example content of nine team member cards 130.

Figure 7:
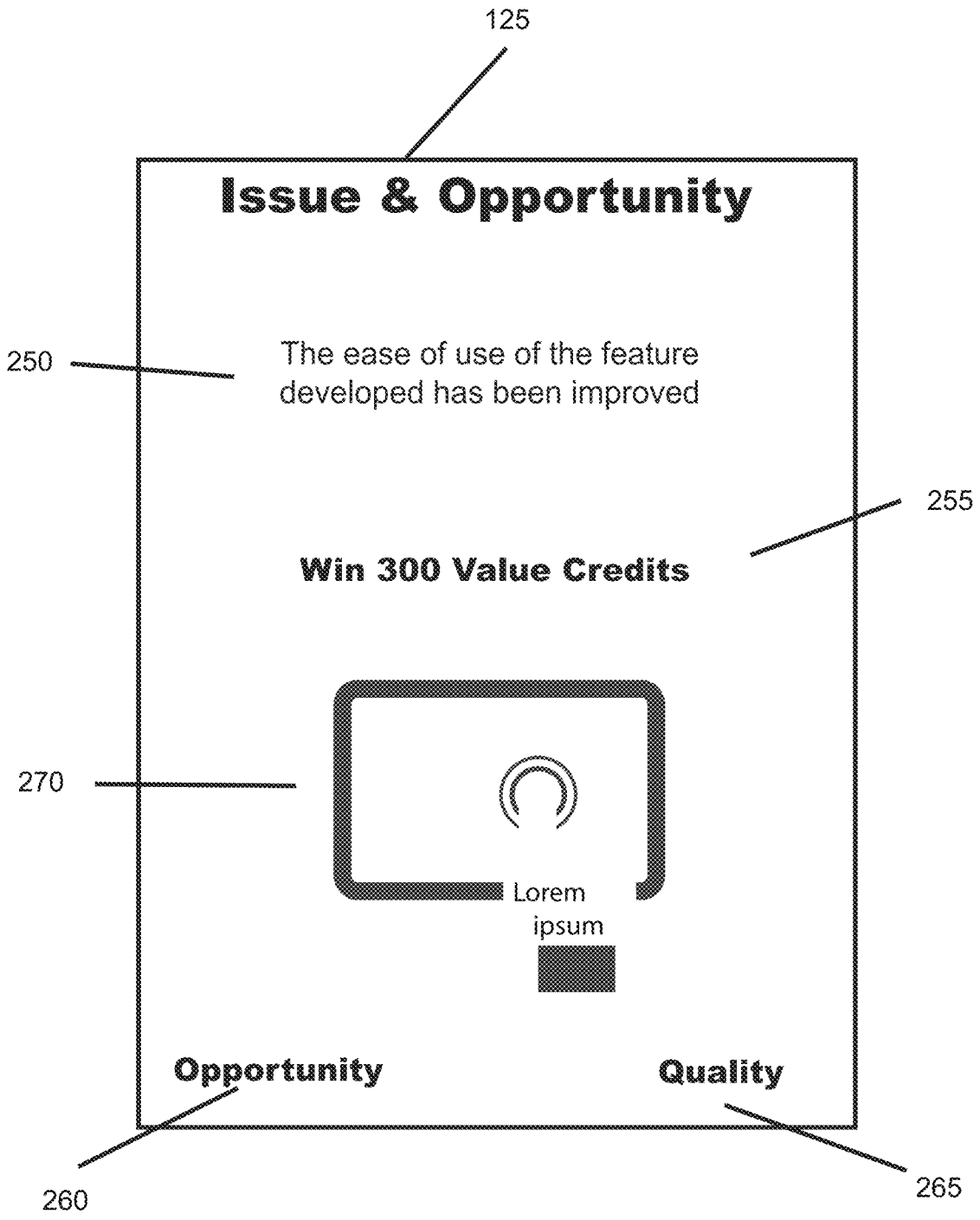
FIG. 7 is a plane view of the issue and opportunity cards representing circumstances during the play.

FIG. 7 illustrates the front face of the issues and opportunity cards 125 for the preferred embodiment. The issues and opportunity cards 125 are situation cards that may arise during a project and positively or negatively impact the project outcome. Each issue and opportunity card 125 have a consequence that speeds up or delays the speed of play, costs money, or increases or decreases work productivity. The card's front face is denoted with the situation 250 and the consequences 255, which are an action required of the player. Furthermore, it has category 260, framework 265, and issue-picture 270. The rear face identifies the card as an issue or opportunity card 125; the color of cards identifies differ by framework. The category 260 and framework 265 are used for classifying and grouping. In the preferred embodiment, there are two category 260 and six frameworks 265. Issue and opportunity are the category 260. The framework 265 are structure, team & roles, technology, strategy, process, and quality. FIG. 7A to 7F provide examples of nine issues and opportunity cards 125 for each framework: 7A is for the process framework, 7B for quality, 7C for strategy, 7D for structure, 7E for team and roles, and 7F for technology.

Figure 8:
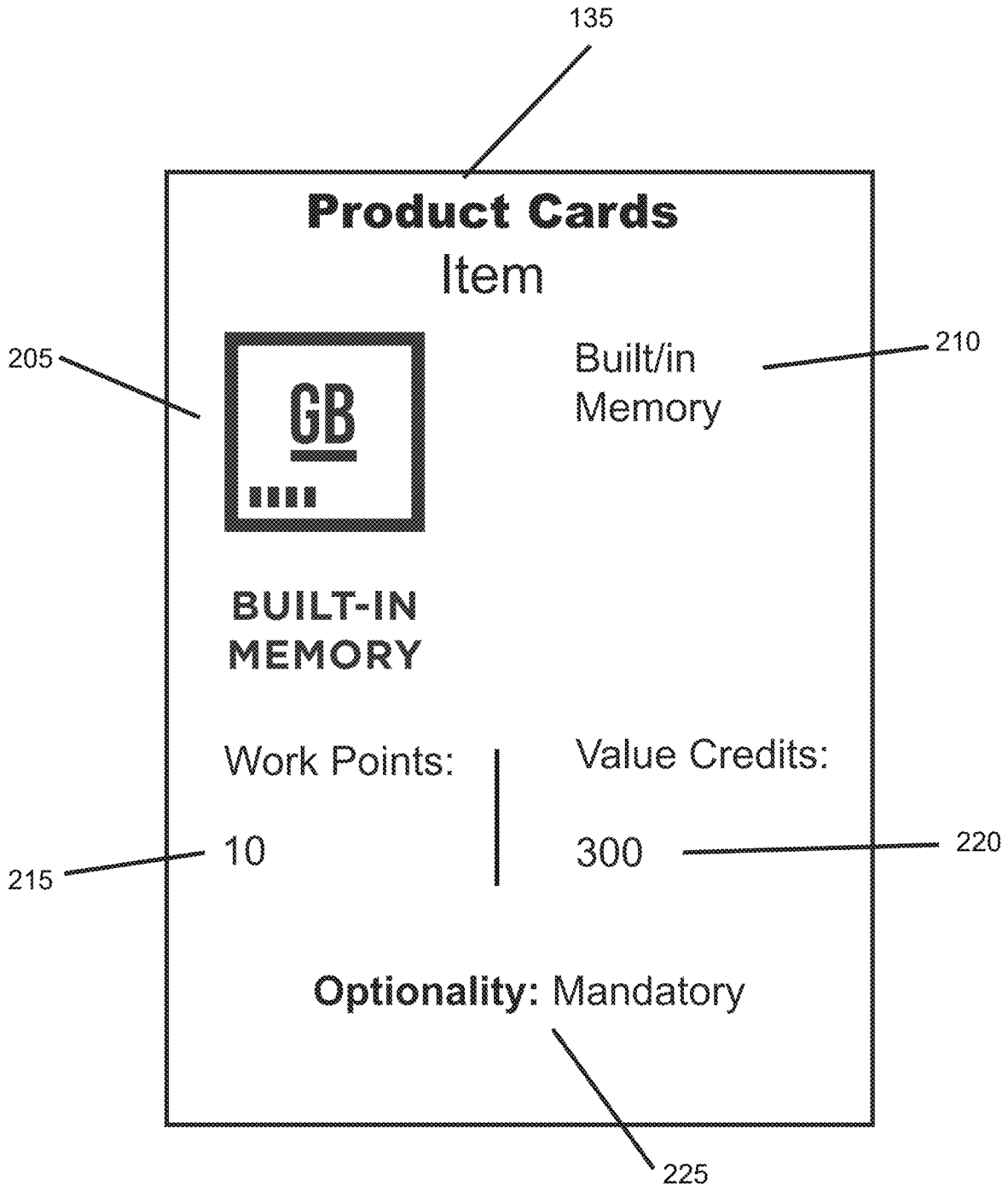
FIG. 8 is a plane view of the product cards that represent features of the product.

FIG. 8 illustrates the front face of the product cards 135 for the preferred embodiment. The product cards 135 represent individual features of the product being constructed during the game. The front face of each card is denoted with at least five attributes: a feature picture 205, feature title 210, work points 215, feature value 220, feature optionality 225. The feature picture 205 and the feature title 210 offer descriptive information. The work points 215 are the work consumption required by people to or construct the feature. The feature value will accrue through the value credit cards 120 if that feature is delivered. The feature value 220 may be zero. The feature optionality 225 classifies if it an optional feature or a mandatory feature. For a player to win, all mandatory features must have been delivered. Each player is given a stack of product cards 135 with the same characteristics; all players are building the same product. The rear face identifies the card as product card 135. FIG. 8A provides example content for nine of the product cards 135.

Figure 9:
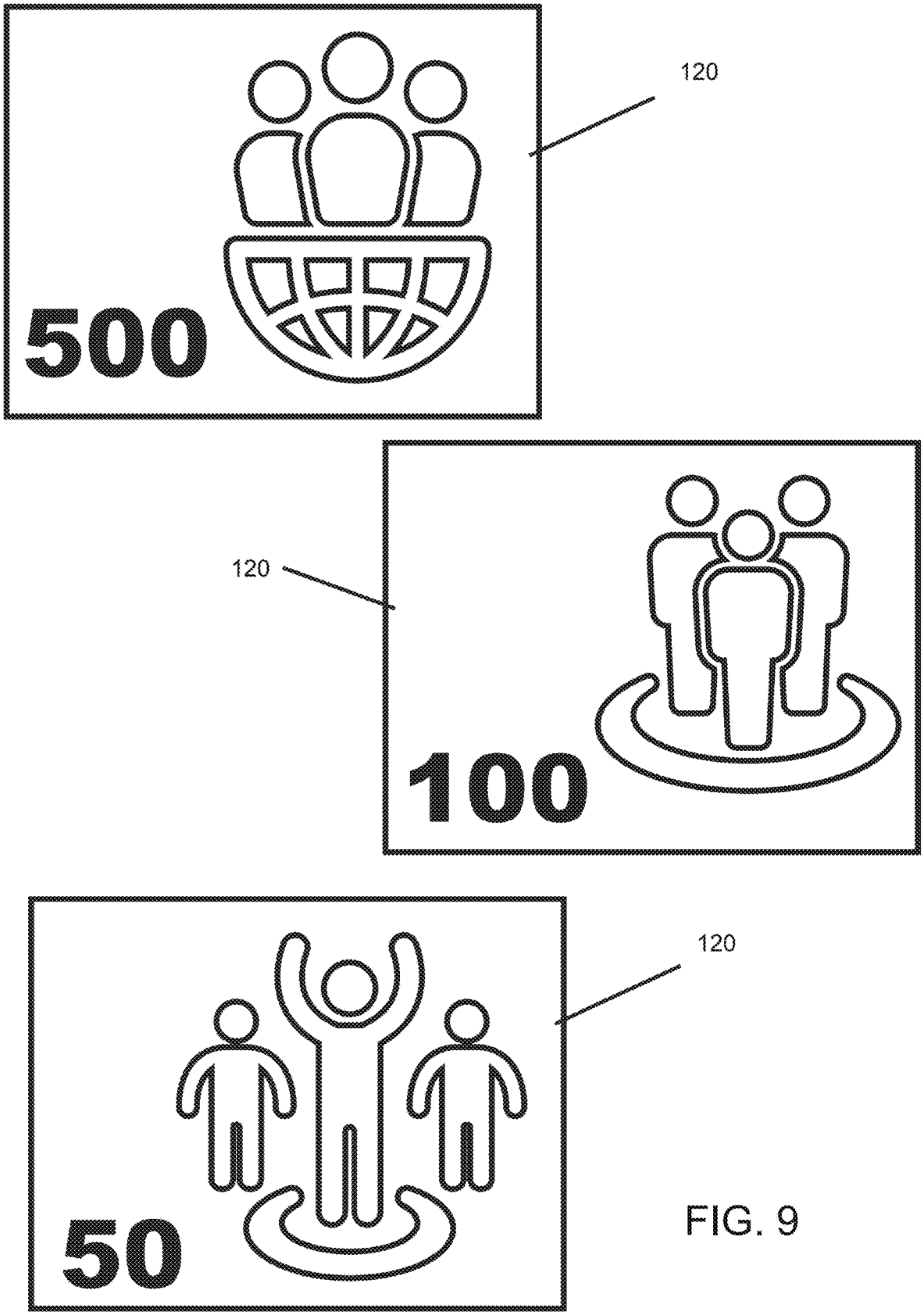
FIG. 9 is a plane view of the value credit cards representing value accumulated through play.
Figure 10:
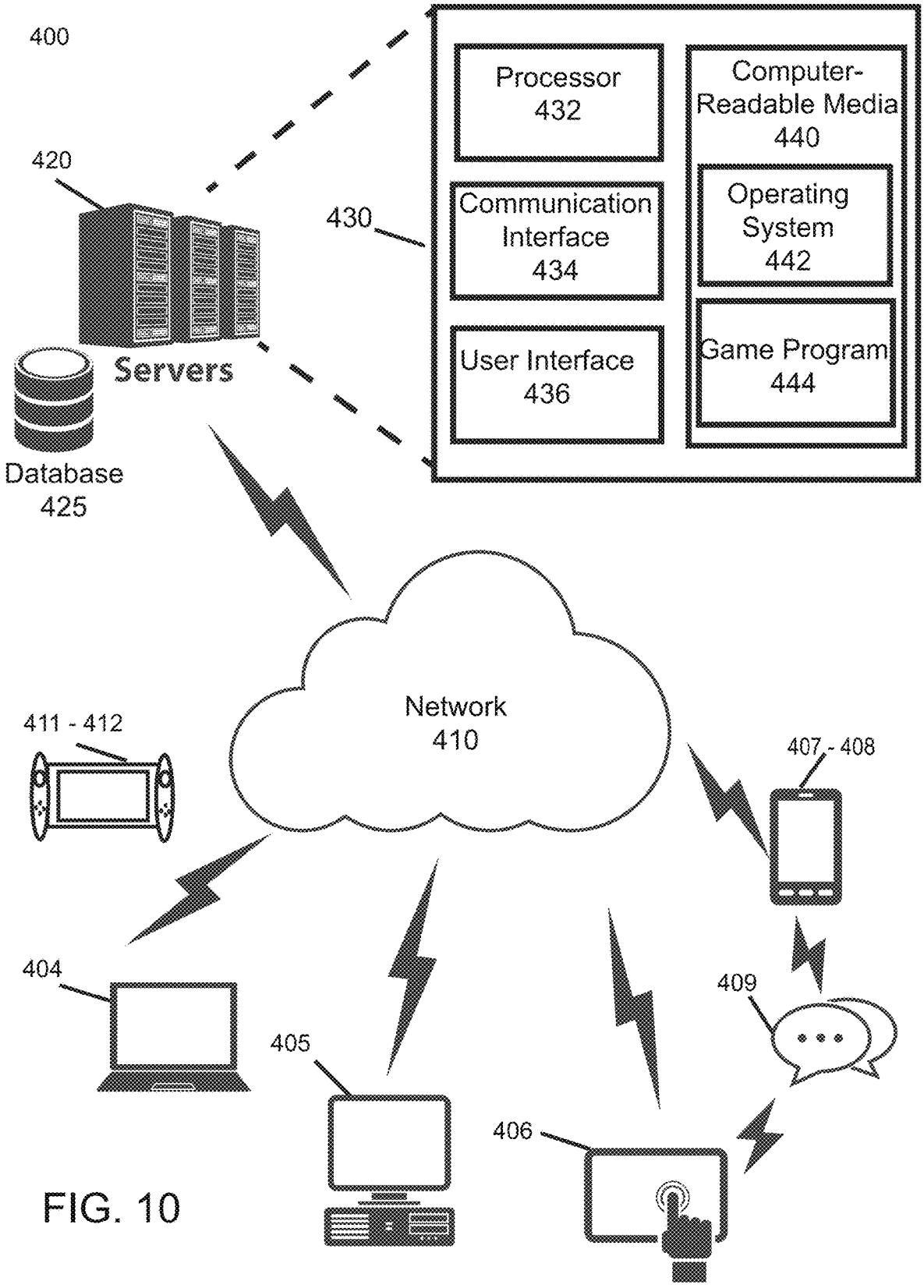
FIG. 10 illustrates the computing environment for hosting and playing the game.

FIG. 9 illustrates the value credit cards 120 in preferred denominations of 50, 100, 500, represented by green, red, and blue, respectively. The denominations and the number of units determine the maximum allowable value for the game. There is a plurality of value credit cards 120 that represent benefits—financial or non-financial—that accrued based on the face value of the product cards, situations presented in the issues and opportunity cards, or other product launch events. The front face of the value credit cards 120 includes a denomination. The back face may comprise the card name or a logo indicator. Each denomination of the card is a different color, FIG. 10 illustrates the computing environment for hosting and playing the game, referred to here as the system. The game program 444 represents the computer-executable code of the system that comprise the components of and logic for the game described herein developed using a known computer programming language or off-the-shelf game engine software. Examples of available game engines include software from Unity Technologies (San Francisco, Calif.), Blender Foundation (Amsterdam, the Netherlands), Epic Games (Cary, N.C. ), The game program 444 includes logic to perform the operations for the dynamic customization of the first methodology, the second methodology, the issue and opportunity cards 125, the product cards 135, the team member cards 130, and other rules of the game. The game program 444 allows the player to select avatars and perform operations such as moving the avatar around the board, selecting cards, allocating money, and reacting to events triggered by the cards. The game program computes and tracks the state of the player's money and value credits; it provides a leader board for cumulating scores across multiple plays for the same players. The game program 444 causes the computer server 420 to perform the operations requested by the player.

The player may use a multitude of computing devices 402 to interact with the computer servers 420, including but not limited to laptop computers 404, desktop computers 405, tablet computers 406, mobile phones 407, smartphones 408, gaming devices 411, gaming consoles 412, or electronic social media platforms 413. The computing devices 402 execute an Internet browser such as google chrome, Microsoft Edge, or Firefox. The computing devices 402 may be based on different operating systems, for example, android, iOS, and Windows. The Internet browser calls the computer servers 420 over a network 410.

FIG. 10 illustrates a computing environment 400 that exemplifies how the system described herein can be hosted, operated, and used. The computing devices 402, computer servers 420, and database 425 can be used individually or collectively in the figure. Database 425 is comprised of database software for storing, manipulating, and retrieving structured or non-structured data. The computing devices 402 is illustrated as including diverse device categories, classes, or types such as laptop computers 404, desktop computers 405, tablet computers 406, mobile phones 407, and is not limited to a specific kind of device. Computer servers 420 can be computing nodes in a computing cluster, for example, cloud services such as Dreamhost, Microsoft Azure, or Amazon Web Services. Cloud computing is a service model where computing resources are shared among multiple parties and available over a network, on-demand.

Computing devices 402 and computer servers 420 can communicate through other computing devices via one or more networks 410. Inset 430 illustrates the details of computer servers 420. The details for the computer servers 420 represent other computing devices such as computing devices 402 and computer servers 420. The computing devices 402 and computer servers 420 can include alternative hardware and software components. For example, computer servers 420 can comprise computer memory and one or more processors 432 connected to one or more computer-readable media 440 via one or more buses. The buses may be a combination of a system bus, a data bus, an address bus, local, peripheral, or independent buses, or any buses. Multiple processors 432 may exchange data via an internal interface bus or a network 410.

Herein, computer-readable media 440 refers to and includes computer storage media. Computer storage media is used to store data and information and includes volatile and nonvolatile memory, persistent and auxiliary computer storage media, removable and non-removable computer storage technology. Communication media can be embodied in computer-readable, infrastructure, data structure, program modules, data signals, and the transmission mechanism.

Computer-readable media 440 can store instructions executable by the processors 432 embedded in computing devices 402, and computer-readable media 440 can store instructions for execution by an external processing unit. For example, computer-readable media 440 can store, load, and execute code for an operating system 442, programs for game program 444, and other programs and applications. One or more processors 432 can be connected to computer-readable media 440 in computing devices 402 or computer servers 420 via the communication interfaces 434 and network 410. For example, program code for the game program 444 can be downloaded from the computer servers 420 to computing devices 402 via the network and executed by one or more processors 432 in the computing devices 402.

User interface 436 can include one or more input devices and one or more output devices. The output devices can be configured for communication to the user or other computing devices 402 or computer servers 420. A display, a printer, audio speaker are example output devices. The input devices can be user-operated or receive input from other computing devices 402 or computer servers 420. Keyboard, keypad, mouse, trackpad, and game controller are examples of input devices.

The avatars 105 may be tagged with a near field communication (NFC) tag. Computer programs must be developed to write the tags, and the game program 444 must be programmed to read the tag. The tags must be embedded into or attached to the avatars 105. Computing devices 402 must contain an NFC reader. When the game is active on computing devices 402, and the avatar 105 with the tag is brought near the NFC reader, the avatar 105 will be read into computing devices 402. The avatar 105 used during the gameplay will take on the avatar characteristics encoded with the NFC tag.

Rules of the Game

The game's objective is to manage a new product development project to deliver the end product and gain as many value credits as possible within the project time and budget constraints. The player must make several project management decisions at the start of play that guides the player's actions throughout the space. The project has risks related to how the product features are delivered, the people's interaction during the project and unexpected events that occur during the play.

The game rules are as follows and are provided in an instruction guide 450. In single-player mode, the player must reach the end-tile 330, having delivered all mandatory product features within the budget determined at the play's outset. The budget is determined based on an allocation of monetary chips 115. In competitive mode, players are the winner when they provide the mandatory product features and have the most value credits when they reach the end-the 330. The type of methodology determines when the player may accumulate value credits. A player is eliminated when they exhaust the budget before delivering all mandatory product features and reaching the end-tile 330. The final position on the board is the tile connected to the end-tile 330. The play continues until all players reach the end-tile 330 or all players are eliminated. The first players on the end-tile 330 continue to roll the numbered dice and, if used, the colored dice until all players are eliminated or reach the end-tile 330. For the numbered dice 110, the player receives the face value in value credit cards 120 multiplied by a factor, for example 20. When the colored dice 111 is used during the game, the player at the end-tile must select an issue and opportunity card 125 matching the color on the colored dice 111. When the colored dice 111 is not used during the game, no issue and opportunity card 125 is selected.

Each player is given the monetary chips 115 worth a given value, an identical set of product cards 135, and an identical set of team member cards 130. A player, non-playing person, or a system must act as the administrator to control and count the distribution of the monetary chips 115 and the value credit cards 120 throughout the play. The issue and opportunity cards 125 are placed next to the game board 300 in one of two modes. If the colored dice 111 is used, the issue and opportunity cards 125 are placed in six stacks by the color of the cards. If the colored dice 111 is not used, the issue and opportunity cards are placed in a single stack. A play may include all issue and opportunity cards 125, a selection of cards from a single framework, or other card distribution. There are 178 issues and opportunity cards divided by framework with 20 for process, 30 for quality, 26 for strategy, 24 for framework, 50 for team and roles, and 28 for technology.

In the preferred embodiment, there are four avatars 105, four identical stacks of the product cards 135 and four identical stacks of the team member card 130, making the maximum number of players four. There are 31 product cards 135 and 40 team member cards 130. The players are given monetary chips 115 of the same value, 10,000. In an alternative playing model, the players can each provide an estimate of amount of monetary chips they require; in this case players may be allocated differing value of monetary chips 115.

At the start of the play, the player must decide the methodology, the team composition using the team member cards 130, and the product features using the product cards 135. For the methodology, the player may decide between a traditional and an agile methodology.

Suppose the player decides on an agile methodology. In that case, they select the product features and team composition for a single iteration. The player accumulates value credits at each iteration-end, i.e., the value credit cards 120 are counted at the end of each iteration. An iteration end is identified by the iteration-end-tiles on the board; the end of one iteration is the start of the next iteration. They pay for the project team at the iteration end. They may change the team composition for the next iteration.

Suppose the player decides on a traditional methodology. In that case, the player must determine the product features and team composition at the beginning of the play for the game duration. The player may change the team composition at each phase-start and change the team composition and product features by passing over one of the change-request tiles 345. The player accumulates value credits throughout the play; however, any value credit cards 120 collected during play are not recognized until they reach or pass the product-launch the 355. They pay for the project team at each phase-start the 340.

For both methodologies, all value credit cards 120 are forfeited at the game end it they have not delivered all mandatory product features.

The player must compose the project team at the start of the play. The type of methodology prescribes minimal skills for the team. In the preferred embodiment, the players selecting the traditional methodology must include a project manager in the team composition. The players selecting the agile methodology must include an agile coach and a product owner in the team composition. All players must include the mandatory roles in the team composition. In the preferred embodiment, a consultant, engineer, and architect are the mandatory roles. Otherwise, the players are free to add other roles to the project team, The player may not include team members that exceed their available money. The cumulative rate on the team member cards must be less than or equal to the player's monetary chips.

The player must decide the product features to develop for the whole project if playing with a traditional methodology. For an agile methodology, the product features are selected for an iteration. The player may not select product features that require more work than their team can deliver based on work points. The work points on the product cards 135 must be less than or equal to the work points on the team member cards 130. The product being developed is a smartphone in the preferred embodiment; thus, all cards are inscribed with details for a smartphone project. However, other types of product development projects may also be considered real estate, buildings, computer software programs, computer hardware, and information systems.

A roll of the numbered dice 110 may be used to determine the player that goes first. Each player selects an avatar 105 and places it at the start-tile 305. To personalize the game, the player may select an avatar 105 that most closely reflects their personal and professional attributes, The player rolls the numbered dice 110 and moves the avatars 105, the number tiles on the board represented on the numbered dice's face. The player reacts based upon directions on the time-tile 310 in which they pass or where they land.

In the traditional methodology, when landing on or passing over the phase-start the 340, the player must pay the team's cost using the monetary chips 115. The price is determined by the cumulative rate of the team members the player has selected using the traditional rate on the face of the team member cards 130. The player collects value credit cards 120 equal to the cumulative value on the front of the product cards 135 for which the player has a matching number of work points 215 on team member cards 130 for people in the player's team. When landing on or passing over the change-request tiles 345, the player may change team members or product cards without additional costs.

In the agile methodology play, when landing on or passing over the iteration-end-tiles, the player must pay the team's cost using the monetary chips 115. The price is determined by the cumulative rate of the team members the player has selected using the agile rate on the face of the team member cards 130. The player collects value credit cards 120 equal to the cumulative value of value on the front of the product cards 135 for which the player has a matching number of work points 215 on team member cards 130 for people in the player's team.

The game can be played in alternative constellations. The issues and opportunity cards 125 may be mixed and match. For example, only one framework of the issue is used for the game. The players may wish to develop a product other than a smartphone, so they would need to alter the product cards 135, the team member cards 130, or both. The players may have specific issues or opportunities that occur in project types in which they are interested. Therefore, the issues and opportunity cards 125, product cards 135, team member cards 130 may be provided with blank attributes. The players may inscribe with personalized project situations and combinations on the cards.

The game can be played as a tabletop game, an online computer game, or a mobile application (app). For a tabletop game, the components are manifested as physical pieces. AN players use the same playing space, i.e., sharing a game board 300. The game board 300 is manufactured on a physical board such as cardboard, plastic, or wood; the issues and opportunity cards 125, team member cards 130, product cards 135, and value credit cards 120 are made of card stock: the monetary chips 115, avatars 105, numbered dice 110, and colored dice 111 are made of composite material such as acrylic styrene-acrylonitrile, carbon fiber, poly-lactic acid, or acrylonitrile butadiene styrene. The instruction guide 450 is printed on paper.

For an online computer game, the game components and game rules are computer-based and manufactured using a software programming language hosted on computer servers 420. The players interact with the hosted game using computing devices 402 over the network 410. Multiple players may play the same playing space simultaneously over a network 410.

For the app's game, the game components and rules are computer-based and manufactured using a software programming language hosted on the computing devices 402 with which the player interacts with the game. Multiple players may simultaneously play the game board 300 through communication technologies 409, such as near field communication, blue tooth, and the network 410.

SUMMARY

The game is attractive to people that plan or work on projects to experience the impacts of their decision on the project outcomes. The players make decisions and attempt to achieve the highest possible value while accounting for real-world issues and opportunities during the project lifecycle. It is fun to experience the impacts of project management decisions in a safe environment.

While this disclosure contains many specific details in the figures and game description, these are not presented as limitations on the claim scope. These details describe features that may be specific to a particular part of a particular invention. Certain features described in this disclosure in the context of separate figures may also be implemented as a single or a combined process. Features described as a single component may also be implemented in multiple components separately or in any suitable combination. Furthermore, although components may be described as combinations in the specification or claims, one or more components may be added to or removed from the combination and directed to an alternative combination or variation of a combination.

The preceding is considered illustrative of the principles of the invention. The description is not intended to limit the invention to a singular or exaction construction and operations. Alternative playing modes and modifications or equivalents may be made and fall within the scope of the invention.

What is claimed is:

1. A board game apparatus for project management decision making consisting of:

a game board with a start-tile: a multitude of time-tiles, an end-tile: a multitude of risk-tiles, and a multitude of alternative routes; where (A) a waterfall methodology is a first methodology on the game board, and an agile methodology is a second methodology on the game board;

(B) where said time-tiles are encoded with actions, where said encodings may be to take an issue and opportunity card, take an alternative route, take action relevant to the first methodology, or take action relevant to the second methodology;

four numbered dice;

a colored dice with each side having a different color;

four identical stacks of 40 team member cards;

four identical stacks of 31 product cards;

160 monetary chips with denominations of 50, 300, 500, and 1000 with 40 units for each denomination;

300 value credit cards with denominations of 1000, 100, and 500, represented by green, red, and blue, respectively, with 100 units for each denomination;

four avatars with unique humanoid appearances;

144 issues and opportunity cards divided by framework with 24 for process, 24 for quality, 24 for strategy, 24 for structure, 24 for team and roles, and 24 for technology, wherein each framework has a color that corresponds to a color on the colored dice;

an instruction guide; and 100 cards with blank attributes that a player may inscribe with personalized project situations and combinations.

* * * * *